US005947635A

United States Patent [19]

Wilson, Sr.

[11] Patent Number: 5,947,635

[45] Date of Patent: Sep. 7, 1999

[54] METHOD FOR SEALING AND MARKING PAVEMENT WITH RECOGNIZABLE INDICIA

[76] Inventor: Jack H. Wilson, Sr., 4654 Hickory Ridge Rd., Jackson, Miss. 39211

[21] Appl. No.: 08/962,676

[22] Filed: Nov. 3, 1997

[51] Int. Cl.[6] ..... E01C 23/08

[52] U.S. Cl. ..... 404/72; 404/75; 427/282

[58] Field of Search ..... 404/93, 94, 111, 404/72, 73, 75, 82; 427/272, 282

[56] References Cited

U.S. PATENT DOCUMENTS

| | | |
|---|---|---|
| 1,732,869 | 10/1929 | Wambach . |
| 2,317,843 | 4/1943 | Backlund . |
| 2,531,370 | 11/1950 | Thompson . |
| 2,989,769 | 6/1961 | Houser . |
| 3,277,511 | 10/1966 | Little et al. . |
| 3,305,887 | 2/1967 | Turner . |
| 3,345,671 | 10/1967 | Wilson et al. . |
| 3,571,841 | 3/1971 | Crouser . |
| 3,841,779 | 10/1974 | Ray . |
| 3,989,403 | 11/1976 | Verive . |
| 3,993,412 | 11/1976 | Drane . |
| 4,020,211 | 4/1977 | Eigenmann . |
| 4,080,228 | 3/1978 | Currigan . |
| 4,172,063 | 10/1979 | O'Brill . |
| 4,191,590 | 3/1980 | Sundheim . |
| 4,367,300 | 1/1983 | Aoki et al. . |
| 4,392,335 | 7/1983 | Heiman . |
| 4,436,845 | 3/1984 | Wilson et al. . |
| 4,575,279 | 3/1986 | Mateja . |
| 4,732,109 | 3/1988 | Selby . |
| 4,767,234 | 8/1988 | Rizzo . |
| 4,789,265 | 12/1988 | Wilson et al. . |
| 4,906,126 | 3/1990 | Wilson et al. . |
| 4,917,533 | 4/1990 | Wilson . |
| 4,959,250 | 9/1990 | McKinnon . |
| 4,959,884 | 10/1990 | Ingermann . |
| 5,021,476 | 6/1991 | Pinomaa . |
| 5,054,159 | 10/1991 | Richardson . |
| 5,239,720 | 8/1993 | Wood . |
| 5,287,583 | 2/1994 | Lilja . |
| 5,301,387 | 4/1994 | Thomas et al. . |
| 5,352,063 | 10/1994 | Allen et al. . |
| 5,362,178 | 11/1994 | Shantz . |
| 5,366,309 | 11/1994 | Springall . |
| 5,385,770 | 1/1995 | Julnes . |
| 5,422,162 | 6/1995 | Passarino . |
| 5,447,752 | 9/1995 | Cobb . |
| 5,472,737 | 12/1995 | Anders . |
| 5,486,067 | 1/1996 | Huynh et al. . |
| 5,502,941 | 4/1996 | Zember et al. . |
| 5,735,952 | 4/1998 | Wilson, Sr. . |
| 5,749,674 | 5/1998 | Wilson, Sr. . |
| 5,792,511 | 8/1998 | Oliver et al. ..... 404/72 X |
| 5,807,022 | 9/1998 | McCleary . |
| 5,817,399 | 10/1998 | Kalman ..... 428/413 |
| 5,826,783 | 10/1998 | Stout ..... 229/120.32 |
| 5,827,009 | 10/1998 | Kokoletsos . |

*Primary Examiner*—James A. Lisehora
*Attorney, Agent, or Firm*—Merek & Voorhees

[57] ABSTRACT

A method of sealing and marking pavement with recognizable indicia. The method can be used in connection with newly formed pavement surfaces or existing pavement which is to be resurfaced. The method includes the steps of providing a marking material to form recognizable indicia on a surface of pavement and applying the marking material to the surface to form such recognizable indicia. The method further includes the steps of providing a protective layer for protecting the recognizable indicia and positioning the protective layer over the recognizable indicia. Next a sealant is provided and applied to an area immediately adjacent the protective layer. The sealant is applied such that its thickness is substantially equal to the thickness of the recognizable indicia. As such, the top surface of the recognizable indicia is in substantially the same plane as the top surface of the sealant.

21 Claims, 3 Drawing Sheets

FIG. 1
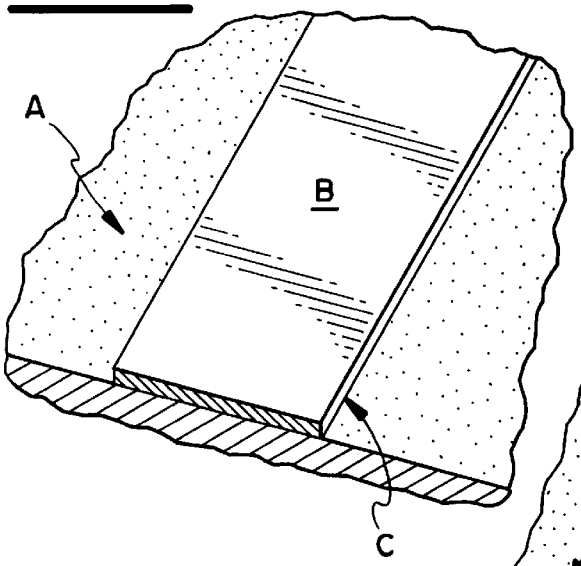
FIG. 2
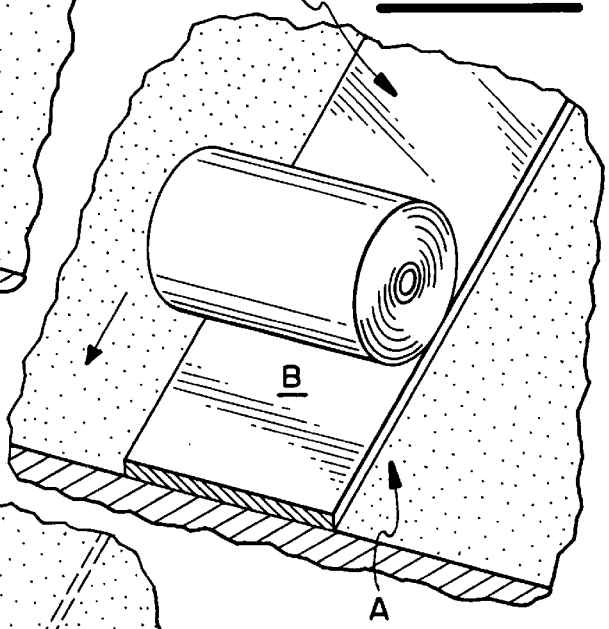
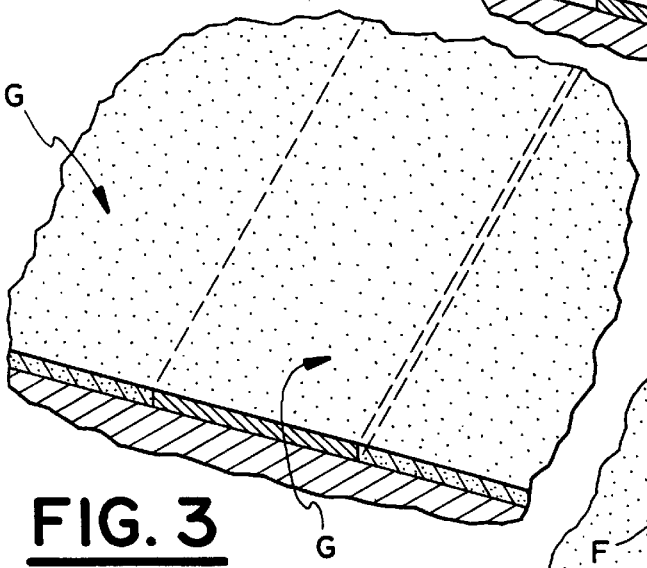
FIG. 3
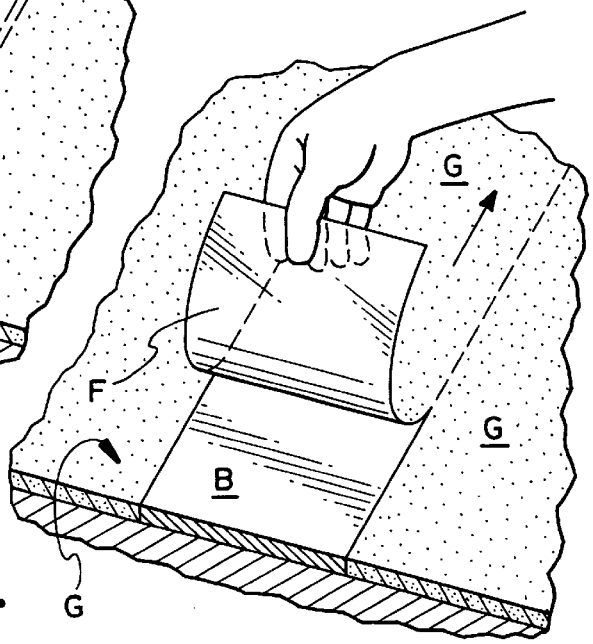
FIG. 4

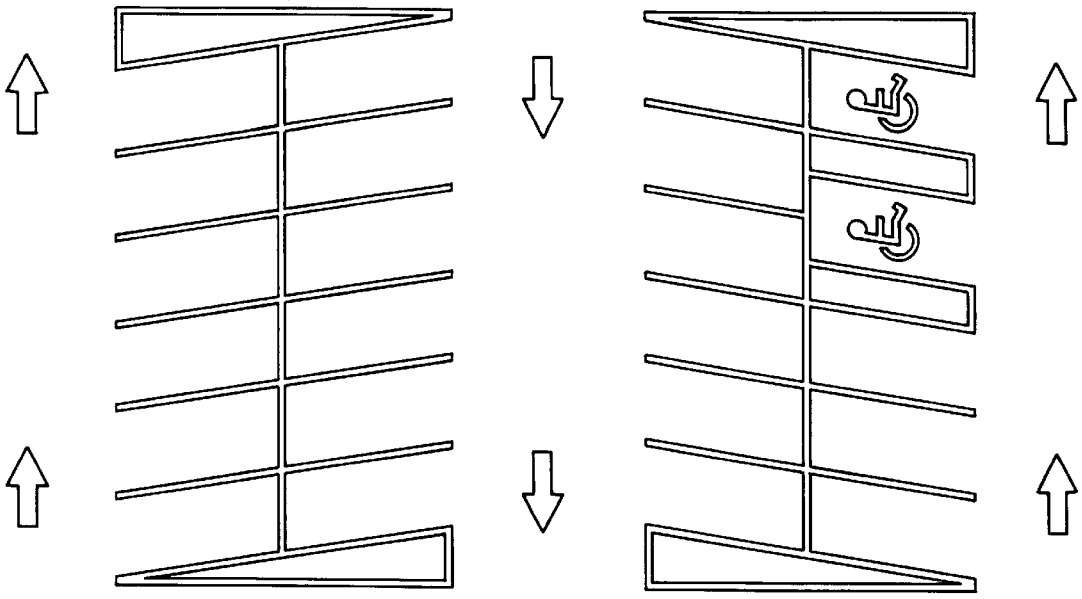
FIG. 5
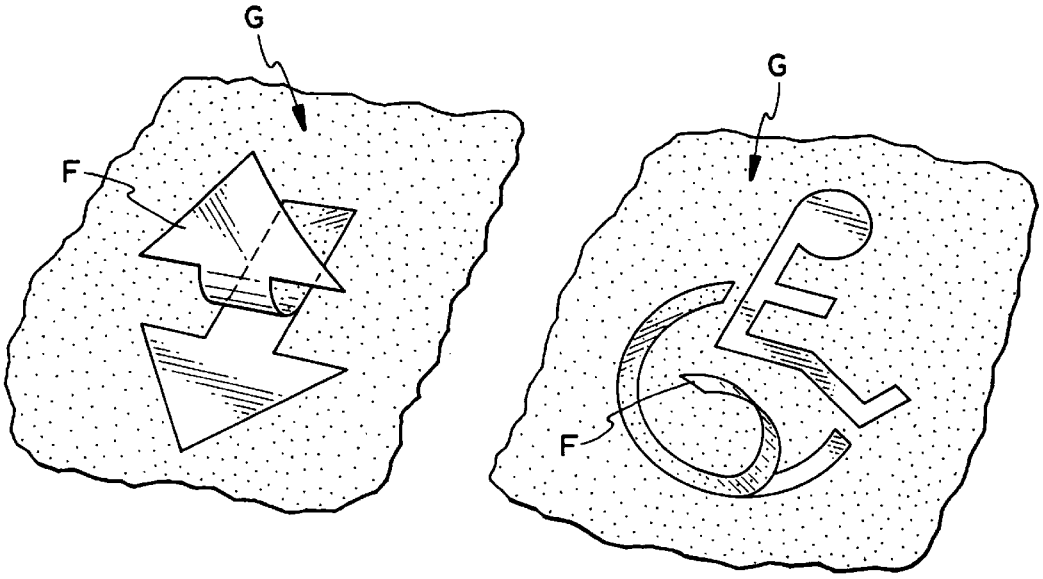

METHOD FOR SEALING AND MARKING PAVEMENT WITH RECOGNIZABLE INDICIA

FIELD OF THE INVENTION

The present invention is directed to a method of sealing and marking a surface with recognizable indicia. In particular, the present invention may be employed to seal and mark parking lots with such recognizable indicia as lines defining parking spaces, symbols identifying handicapped parking, or wording identifying parking for a particular establishment. It should be noted that these examples are not to be construed as limiting the ordinary meaning of the phrase "recognizable indicia."

BACKGROUND OF THE INVENTION

Numerous surfaces must be both sealed from the elements and marked with recognizable indicia. One such example is parking facilities or lots. Parking lots are often paved with asphalt. Asphalt parking lots are particularly prone to deterioration by water and oxidation if left unprotected. In fact, a very large industry has existed in the U.S. for a number of years to prevent or significantly retard deterioration of asphalt surfaces. This industry is commonly referred to as the Asphalt Sealing Industry. This industry involves various entities which make, sell and apply protective sealants to asphalt surfaces (new and old) to retard oxidation and protect asphalt from the harmful effects of inclement weather (e.g. snow and ice) and fluids leaking from automotive vehicles.

It is common place for owners of establishments having asphalt surfaces to employ sealcoat contractors to seal the surface to prevent its deterioration. Coal tar sealants have been used to seal asphalt surfaces. However, the invention described herein reveals the use and advantages of polymer fortified portland cement as an asphalt sealant. Such sealants are effective to prevent deterioration by water and oxidation of the asphalt surface.

In addition to sealing asphalt surfaces, it is common place to mark these surfaces with recognizable indicia to provide various information to employees or customers of the particular establishment. For example, it is common place to mark parking facilities with parallel lines to identify parking spaces. Further, well known symbols are employed to inform individuals that parking in a particular space is restricted. Specifically, the well known handicap symbol is applied to asphalt paving between parallel lines to designate handicap parking. Other recognizable symbols commonly used in parking lots include arrows to identify the direction of traffic flow.

These and other well known markings are applied after the asphalt pavement has been sealed with a sealant. Hence, the markings are generally raised between about 1/32 of an inch and 1/8 of an inch due to the thickness of the marking material. Because the recognizable markings are raised and thereby exposed they are subject to rapid deterioration. One example where the raised lines cause rapid deterioration is in climates where snow removal equipment is used to remove snow during the winter season. Since the lines are raised, they are particularly susceptible to damage or destruction when snow is removed by conventional equipment. Accordingly, the markings must be frequently reapplied. It will be readily appreciated from the foregoing that a real and significant need exists for a method of sealing and marking surfaces such as asphalt parking lots which does not leave the markings exposed i.e. raised from the sealant thereby significantly prolonging the life of the markings. Additionally, conventional painted markings can help cause cracking in asphalt surfaces by creating a temperature differential between the asphalt under the painted area and the surrounding black pavement by reflecting heat and causing the asphalt under the painted area to be of lower temperature than the surounding pavement and causing differences in thermal expansion of the asphalt.

OBJECTS AND SUMMARY OF THE INVENTION

An object of the present invention is to provide a novel and unobvious method for sealing and marking surfaces with recognizable indicia.

Another object of the present invention is to employ a simple and relatively inexpensive method for sealing and marking surfaces with recognizable indicia.

A further object of the present invention is to provide a method of sealing and marking surfaces with recognizable indicia such that the recognizable indicia is not raised above the top surface of the sealant.

Yet a further object of the present invention is to provide a method of sealing and marking a surface with recognizable indicia which significantly prolongs the life of the indicia.

Still another object of the present invention is to prevent cracking of asphalt under the indicia through the use of polymer fortified portland cement as the marking agent.

Yet another object of the present invention is the use of polymer fortified portland cement as an asphalt coating material.

These and other objects of the present invention will be readily apparent upon a review of the following detailed description of the preferred form of the invention and the accompanying drawings. These objects are not exhaustive and are not to be construed as limiting the scope of the claimed invention.

In summary, the present invention is directed to a method of sealing pavement and marking pavement with recognizable indicia. The method can be used in connection with newly formed pavement surfaces or existing pavement which is to be resurfaced. The method includes the steps of providing a marking material to form recognizable indicia on a surface of pavement and applying the marking material to the surface to form such recognizable indicia. The method of the present invention further includes the steps of providing a protective layer for protecting the recognizable indicia and positioning the protective layer over the recognizable indicia. Next a sealant is provided and applied to an area immediately adjacent the protective layer. The sealant is applied such that its thickness is substantially equal to the thickness of the recognizable indicia. As such, the top surface of the recognizable indicia is in substantially the same plane as the top surface of the sealant.

The above summary describes a preferred form and is not in any way to be construed as limiting the claimed invention to the preferred form.

BRIEF DESCRIPTION OF THE INVENTION

FIG. 1 is a fragmentary perspective view of one step of the present invention, i.e. applying the marking material to a pavement surface to form recognizable indicia thereon.

FIG. 2 is a fragmentary perspective view of another step of the present invention, i.e. positioning the protective layer over the recognizable indicia illustrated in FIG. 1.

FIG. 3 is a fragmentary perspective view after the seal has been applied to the protective layer and the immediately adjacent area.

FIG. 4 is a fragmentary perspective view illustrating the removal of the protective layer and the common plane occupied by the top surface of the recognizable indicia and the top surface of the sealant.

FIG. 5 illustrates examples of recognizable indicia to be applied to the surface of pavement.

DETAILED DESCRIPTION OF THE INVENTION

The preferred method of the present invention will now be described with reference made to FIGS. 1 through 9.

FIGS. 1 THROUGH 9

Referring to FIG. 1, a portion of an asphalt pavement surface A is illustrated. In the preferred form, the asphalt pavement surface A is a parking lot. The asphalt pavement surface A can be newly formed in the case of new construction or can be an existing pavement merely resurfaced. In either event, the techniques for forming new pavement or resurfacing existing pavement are well known to those skilled in the art and therefore need not be explained herein in detail. One technique for resurfacing pavement is disclosed in my co-pending U.S. patent application Ser. No. 08/707,449 the entire contents of which is incorporated herein by reference. Suffice to say for purposes of this invention is that a relatively smooth and unprotected pavement surface need be provided. Once such a surface exists, either by new construction or resurfacing existing pavement, a marking material B is applied to the surface A. Preferably, the marking material B is the type sold under the name PERMALINE which is a mixture of white polymer fortified cement and white sand. PERMALINE has advantages over paint or tape because it bonds to the pavement and has sufficient strength to resist cracking due to temperature differentials which normally occur between black asphalt and asphalt coated with a more heat reflective coating. It will be readily appreciated that other suitable materials may be used. It should also be understood that colored pigments may be added to provide colored markings such as blue, yellow or any other desired color.

Figure 6:
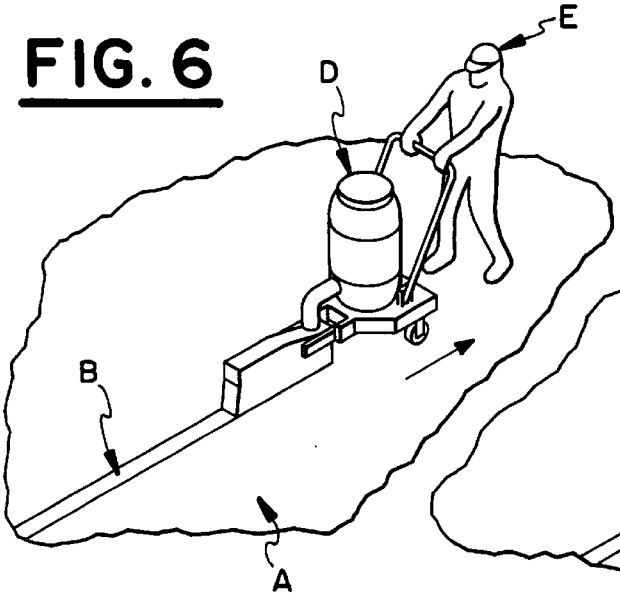
FIG. 6 is a fragmentary perspective view of the step of applying a marking material to form a recognizable indicia (in this case a line) to the surface of pavement.

The marking material B as shown in FIG. 1, is applied in line form to the surface A to identify parking spaces. Other readily recognizable indicia commonly formed on a parking lot are illustrated in FIG. 5. The thickness C of the marking material B preferably ranges from ⅛ of an inch to about 1/32 of an inch. Any conventional applicator may be used to apply the marking material to form recognizable indicia on a pavement surface. Referring to FIG. 6, the marking applicator D could be of the type propelled by an individual E. In addition, the marking applicator could be of the spray type or any other conventional device used to form lines or similar recognizable indicia on pavement surfaces. Preferably, the particular site such as a parking lot is completely marked with all the desired recognizable indicia. The marking material must be permitted to dry. The drying time will vary but should generally be approximately a couple of hours.

Figure 7:
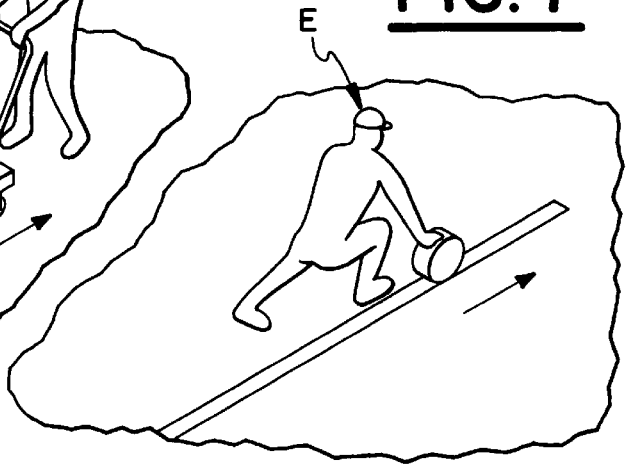
FIG. 7 is a fragmentary perspective view of the preferred step of positioning the protective layer over the recognizable indicia.

Once the marking material has sufficiently dried a protective layer F is applied over all of the recognizable indicia. Preferably, the protective layer is masking tape of the type sold under the name SPECTAPE. Referring to FIG. 7, the protective layer F can be applied by an individual E. It will be readily appreciated that the protective layer F may be applied by machine. Referring to FIGS. 2 and 4, preferably, the protective layer F has the same size and shape as the recognizable indicia. The importance of this aspect of the invention will be explained below.

Figure 8:
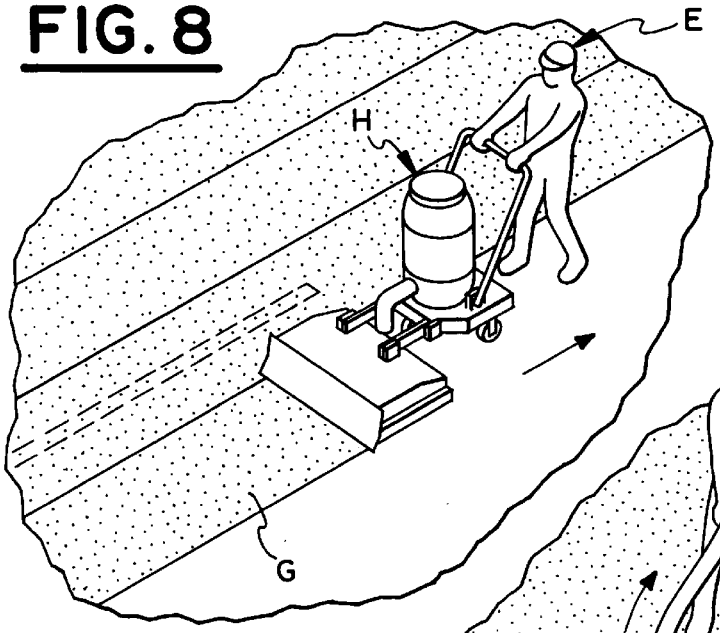
FIG. 8 is a fragmentary perspective view of the step of applying sealant over the protective layer and the adjacent area.

Once the protective layers F are positioned over all the recognizable indicia, the sealant G is applied over the pavement surface A and may spill onto the protective layers F or even be applied thereover to save time as shown in FIGS. 3 and 8. Polymer fortified portland cement is preferred as the sealant G since it has the advantages over coal tar sealants of being substantially more resistant to deterioration and can be easily applied in a thickness equal to the recognizable indicia. The sealant G is applied such that its thickness is substantially the same as the thickness of the marking material B. As such the top surface of the sealant G occupies substantially the same plane as the top surface of the marking material B. Accordingly, the recognizable indicia such as parking space lines, handicap designations and traffic flow arrows are not raised and therefore not subject to rapid deterioration.

Figure 9:
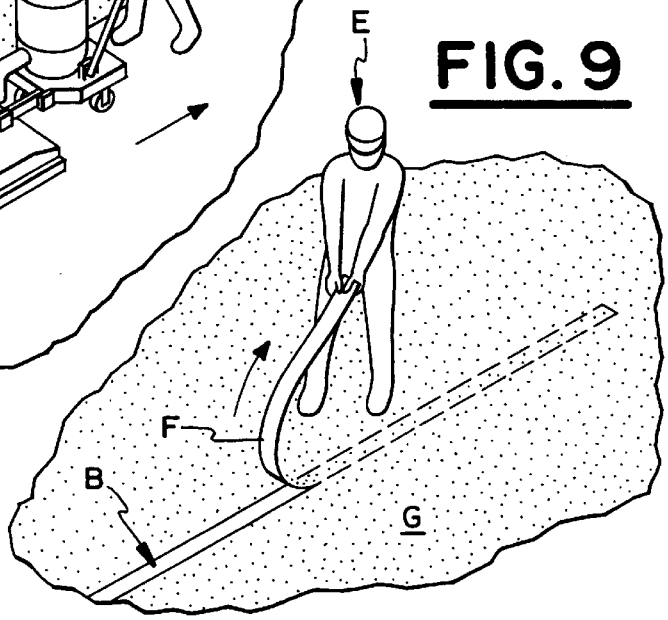
FIG. 9 is a fragmentary perspective view of an individual removing the protective layer.

After the sealant has sufficiently dried, the protective layers F are removed (see FIGS. 4 and 9). Referring to FIG. 4, it is important that the protective layer be of the same size and shape as the recognizable indicia to ensure that all unmarked areas of pavement are sealed. For example, if the 6 inch wide tape was centered over 4 inch wide parking space lines a one inch wide strip of unprotected pavement would exist on each side of the parking space line. This would be undesirable in that these area would be subject to rapid deterioration experienced by unprotected asphalt. Preferably, the sealant G is of the type sold under the name ENVIRO-KRETE. This black sealant is a polymer fortified portland cement coating. While this is the preferred sealant it will be readily appreciated that other conventional sealants such as coal tar sealants may be used. The sealant G can be applied by an applicator H propelled by an individual. The applicator H preferably is of the type disclosed in my co-pending patent application Ser. No. 08/593,289 the entire contents of which is incorporated by reference. It will be appreciated that other known applicators may be used.

While this invention has been described as having a preferred design, it is understood that is capable of further modifications, uses and/or adaptions of the invention following in general the principle of the invention and including such departures from the present disclosure as come within the known or customary practice in the art to which the invention pertains and as maybe applied to the central features hereinbefore set forth, and fall within the scope of the invention and the limits of the appended claims.

What is claimed:

1. A method of sealing and marking pavement, said method comprising the steps of:

a) providing a marking material to form a recognizable indicia on a surface of pavement;

b) applying a marking material to a surface of pavement to form a recognizable indicia on the surface, the recognizable indicia having a top surface;

c) providing a protective layer for protecting the recognizable indicia;

d) positioning the protective layer over the recognizable indicia;

e) providing a sealant to seal an area immediately adjacent the recognizable indicia; and f) applying the sealant to the area such that a top surface of the sealant lies in substantially the same plane as the top surface of the marking material.

2. The method as set forth in claim 1, further including the step of:

a) removing the protective layer after applying the sealant to the immediately adjacent area.

3. The method as set forth in claim 1, further including the step of:

a) forming pavement prior to the step of applying the marking material.

4. The method as set forth in claim 1, further including the step of:

a) resurfacing existing pavement prior to the step of applying the marking material.

5. The method as set forth in claim 1, further including the step of:

a) applying a polymer fortified portland cement sealant to the area such that the sealant has a thickness substantially equal to the first thickness of the marking material.

6. The method as set forth in claim 1, further including the step of:

a) applying the marking material such that the first thickness is between ⅛ of an inch and about 1/32 of an inch.

7. A method of sealing and marking parking lots with lines for defining parking spaces, said method comprising the steps of:

a) providing a marking material to form lines for parking lots to define parking spaces;

b) applying the marking material to the surface of a parking lot to form at least one line of a parking space, the at least one line having a first thickness;

c) providing a protective layer for protecting the at least one line;

d) forming the protective layer such that it has substantially the same length and width as the at least one line;

e) positioning the protective layer over the at least one line;

f) providing a sealant to seal the area of the parking lot immediately adjacent the at least one line;

g) applying the sealant to the area such that at least a portion of the sealant lies in substantially the same horizontal plane as the marking material.

8. The method as set forth in claim 7, further including the step of:

a) removing the protective layer after applying the sealant to the immediately adjacent area.

9. The method as set forth in claim 7, further including the step of:

a) forming pavement prior to the step of applying the marking material.

10. The method as set forth in claim 7, further including the step of:

a) resurfacing existing pavement prior to the step of applying the marking material.

11. The method as set forth in claim 7, further including the step of:

a) applying polymer fortified portland cement sealant to the area and over the protective layer such that the sealant has a thickness substantially equal to the first thickness of the marking material.

12. The method as set forth in claim 7, further including the step of:

a) applying the marking material such that the first thickness is between about ⅛ of an inch and about 1/32 of an inch.

13. The method as set forth in claim 7, further including the step of:

a) applying the marking material such that the first thickness is about ⅛ of an inch.

14. A method of marking pavement with a recognizable symbol and sealing the immediately adjacent surface, said method comprising the steps of:

a) providing a marking material to form a recognizable symbol on a surface of pavement;

b) applying the marking material to the surface of pavement to form at least one recognizable symbol on the surface of pavement, the at least one recognizable symbol having a first thickness;

c) providing a protective layer for protecting the at least one recognizable symbol;

d) forming the protective layer such that it conforms to the size and shape of the recognizable symbol;

e) positioning the protective layer over the at least one recognizable symbol;

f) providing a sealant to seal the area of the pavement immediately adjacent the at least one recognizable symbol;

g) applying the sealant to the area such that at least a portion of the sealant lies in substantially the same horizontal plane as at least a portion of the marking material.

15. The method as set forth in claim 14, further including the step of:

a) removing the protective layer after applying the sealant to the immediately adjacent area.

16. The method as set forth in claim 14, further including the step of:

a) forming pavement prior to the step of applying the marking material.

17. The method as set forth in claim 14, further including the step of:

a) resurfacing existing pavement prior to the step of applying the marking material.

18. The method as set forth in claim 14, further including the step of:

a) applying a polymer fortified portland cement sealant to the area such that the sealant has a thickness substantially equal to the first thickness of the marking material.

19. The method as set forth in claim 14, further including the step of:

a) applying the marking material such that the first thickness is between about ⅛ of an inch and about 1/32 of an inch.

20. The method as set forth in claim 14, further including the step of:

a) applying the marking material such that the first thickness is about ⅛ of an inch.

21. A method of sealing and marking pavement, said method comprising the steps of:

a) providing a marking material to form a recognizable indicia on a surface of pavement;

b) applying a marking material to a surface of pavement to form a recognizable indicia on the surface, the recognizable indicia having a top surface;

c) providing a protective layer for covering the marking material applied to the surface;

d) positioning the protective layer over the marking material such that the marking material is completely covered;

e) providing a sealant to seal an area immediately adjacent the recognizable indicia; and f) applying the sealant such that a top surface of the sealant lies in substantially the same plane as the top surface of the marking material.

* * * * *